United States Patent [19]

Vann et al.

[11] 4,330,039

[45] May 18, 1982

[54] PRESSURE ACTUATED VENT ASSEMBLY FOR SLANTED WELLBORES

[75] Inventors: Roy R. Vann; George W. Ribble; Flint R. George, all of Houston, Tex.

[73] Assignee: Geo Vann, Inc., Houston, Tex.

[21] Appl. No.: 166,547

[22] Filed: Jul. 7, 1980

[51] Int. Cl.[3] ..... E21B 34/10; E21B 43/117; E21B 43/12

[52] U.S. Cl. ..... 166/297; 166/299; 166/317; 166/323

[58] Field of Search ..... 166/299, 319, 317, 321, 166/323; 175/4.52, 4.51, 4.56

[56] References Cited

U.S. PATENT DOCUMENTS

| | | | |
|---|---|---|---|
| 3,662,834 | 5/1972 | Young | 166/319 X |
| 3,706,344 | 12/1972 | Vann | 175/4.56 X |
| 3,931,855 | 1/1976 | Vann et al. | 166/128 |
| 4,194,577 | 3/1980 | Vann | 175/4.51 |

*Primary Examiner*—Stephen J. Novosad
*Attorney, Agent, or Firm*—Marcus L. Bates

[57] ABSTRACT

A pressure actuated vent assembly for completing a slanted wellbore. The assembly is connected in series relationship within a tubing string at a location below a packer, and the packer elements are located between the casing and the tubing string, thereby dividing the casing annulus into an upper and lower annular area. The vent assembly includes a ported sliding sleeve which is slidably received about a ported main body member. The sleeve is held into position by a shear pin. Guide pins maintain the ports of the sleeve and main body member aligned with one another. When pressure is applied to the inside of the tubing, the sliding sleeve is forced to slide from an upper closed position, in a downward direction, where the sleeve locks into the opened position. The vent assembly is especially useful in slanted boreholes because various tools may be circulated down through the axial passageway of the assembly and downhole to perform a number of different downhole operations, such as completing a new wellbore, for example.

20 Claims, 3 Drawing Figures

PRESSURE ACTUATED VENT ASSEMBLY FOR SLANTED WELLBORES

BACKGROUND OF THE INVENTION

In the art of producing hydrocarbons from underground production zones, it is usually necessary to form a wellbore down through the oil bearing strata, cement a casing into the wellbore; and, thereafter communicate the hydrocarbon containing formation with the surface of the earth. This is generally accomplished in all sorts of different specific manners by perforating the casing and thereafter flowing the hydrocarbons up a tubing string. It is advantageous to isolate the lower production zone by the employment of a packer device interposed between the casing and the tubing string, so that flow from the formation can be confined to the upper tubing string.

U.S. Pat. No. 3,706,344 to Roy R. Vann, there is taught a permanent completion method and apparatus by which the above can be accomplished in an improved manner so that more economical production can be obtained. In U.S. Pat. Nos. 3,871,448; 3,931,855; and 4,040,485 to Roy R. Vann, et al. there is disclosed a packer actuated vent assembly by which the before mentioned well completion techniques can be accomplished. These techniques work satisfactory when carried out in vertical boreholes, but when the borehole is slanted, sometimes difficulty is encountered, especially when the slanted part of the borehole approaches the horizontal, as seen in the Vann U.S. Pat. No. 4,194,577; for example.

There are many instances where the lower marginal end of a borehole approaches a horizontal plane. For example, when drilling multiple boreholes from a single platform, it is not unusual to form a multiplicity of slanted boreholes which radiate from a single platform.

The present invention provides a vent assembly which enables the method set forth in U.S. Pat. No. 3,706,344 to be carried out in slanted boreholes in a more satisfactory manner.

SUMMARY OF THE INVENTION

A pressure actuated vent assembly for connection in series relationship within a tubing string. A packer device is located above the vent assembly for packing off the upper annulus from the lower annulus. When the casing is perforated and the vent assembly moved into the open position, fluid can flow from a production zone, through the casing perforations, into the lower borehole annulus, up the annulus into the vent assembly, and up the tubing string to the surface of the earth. The vent assembly includes an outer sub having an upper end by which it is connected into the upper tubing string.

A hollow mandrel has one end affixed to the interior of the sub, and a marginal length of the mandrel is spaced from a skirt of the sub to form a downwardly opening, circumferentially extending annulus. The lower end of the mandrel is connected to the lower tubing string. Ports are formed through the skirt of the mandrel. An axial passageway extends through the vent assembly to provide unobstructed access to the lower tubing string.

A sliding sleeve is received within the annulus, with there being a variable chamber formed between the sliding sleeve and the upper blind end of the downwardly opening annulus.

Ports are formed within the sliding sleeve, and when the sleeve is moved respective to the mandrel and sub, the ports of the sleeve and the mandrel come into registry with one another. Guide means cause the ports to be indexed in registered relationship with one another when the sliding sleeve is moved to the open position. Seal means between the mandrel, sliding sleeve, and skirt prevent fluid flow from the assembly when the sleeve is in the closed position.

A shear pin releasably locks the sleeve in the closed position, while a detent and latch means capture the sleeve so that it is latched into the opened position.

In carrying out the method of the present invention, a predetermined pressure is applied to the interior of the tubing string, causing a downward force to be applied to the sliding sleeve, until the shear pin is sheared whereupon the sleeve is forced to move into the latched opened position, and flow can occur through the aligned opened ports.

Accordingly, a primary object of the present invention is the provision of a pressure actuated vent assembly for use downhole in a slanted borehole for communicating a lower borehole annulus with the interior of a tubing string.

Another object of this invention is the provision of a pressure actuated vent assembly which forms part of a fluid conduit, and which includes closed flow ports which are moved to the opened position when a predetermined elevated pressure is exerted upon the interior of the vent assembly.

Still another object of this invention is the provision of a pressure actuated vent assembly which is held in the closed position until a predetermined pressure is exerted thereon, whereupon the ports of the vent assembly are moved into an opened position.

A still further object of this invention is the provision of a pressure actuated vent assembly having an annular piston which is forced to move when subjected to a predetermined pressure to thereby align spaced apart ports so that flow can occur into the assembly.

Another and still further object of this invention is the provision of a pressure actuated vent assembly which enables an unobstructed flow path to be maintained from the surface of the ground downhole to the bottomof a tubing string, and at the same time enables communication to be achieved between a lower borehole annulus and a marginal length of the tubing string by applying pressure internally of the tubing string so as to open a flow port.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
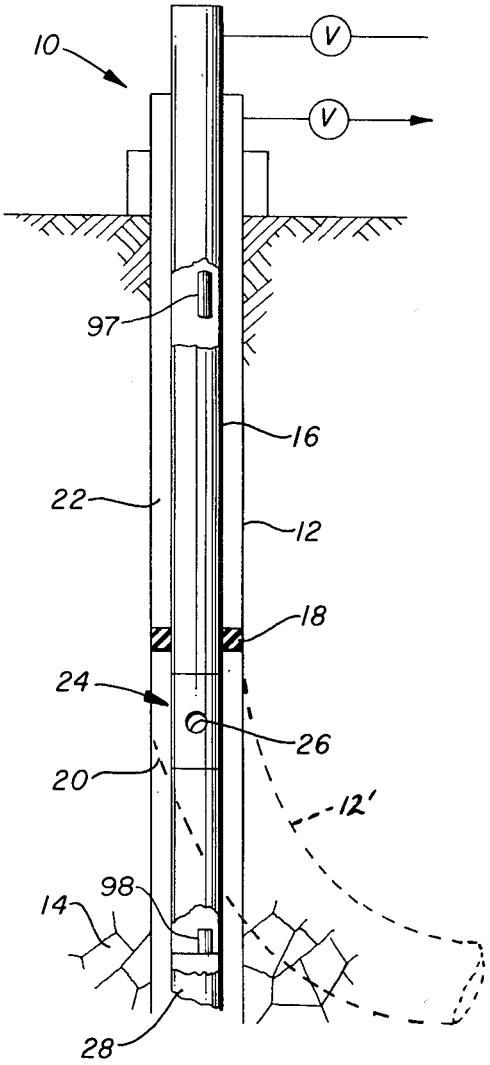
FIG. 1 is a diagrammatical, hypothetical view of a cross-section of a borehole extending downhole into the earth and having apparatus made in accordance with the present invention associated therewith.

In FIG. 1, there is disclosed a borehole which extends downhole into the earth. The borehole has the usual wellhead 10 connected to a casing 12 or 12'. The casing extends downhole to a production zone 14. Tubing string 16 also extends from the wellhead, down through the casing, and includes a packer device 18 which packs off a marginal, annular area between the tubing and casing. The packer therefore divides the casing annulus into a lower annulus 20 and an upper annulus 22. The borehole can be vertical, as illustrated, or slanted, as seen at 12'.

A pressure actuated vent assembly 24, made in accordance with the present invention, is interposed in series relationship within the tubing string. The apparatus includes a vent port 26. Other apparatus, such as a perforating gun 28, is included in the tubing string.

Figure 2:
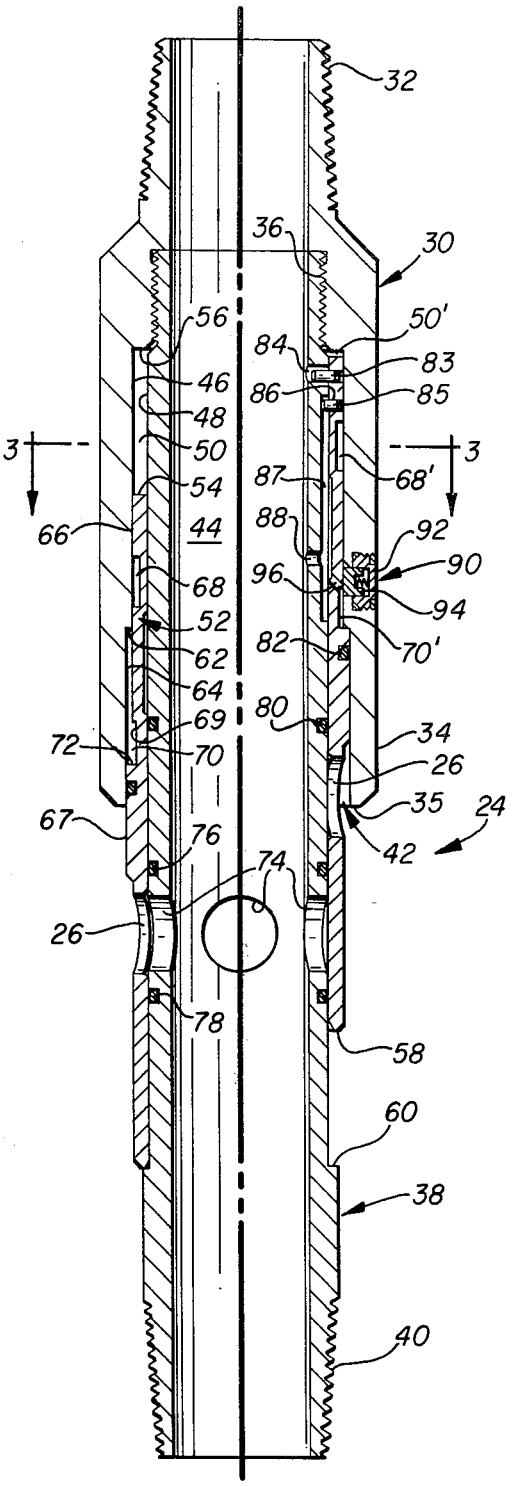
FIG. 2 is an enlarged, longitudinal, cross-sectional view of part of the apparatus disclosed in FIG. 1 with the right side thereof showing the apparatus in one position and the left side thereof showing the apparatus in another; and, FIG. 3 is a cross-sectional view taken along line 3—3 of FIG. 2.
Figure 3:
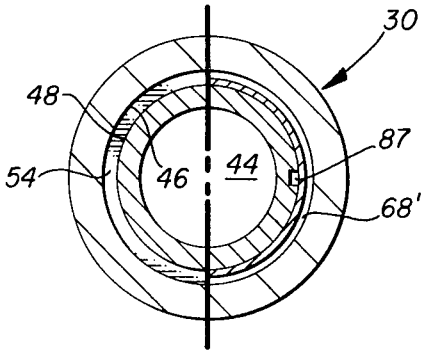

As seen illustrated in FIGS. 2 and 3, the pressure actuated vent assembly 24 of the present invention includes an outer sub 30 having an upper threaded surface 32 by which the vent assembly can be connected to the box end of the tubing string. The sub has a downwardly extending outer skirt 34 which terminates at lower, circumferentially, extending edge portion 35.

The interior of the sub includes a threaded surface 36 formed along an upper marginal length of the interior thereof. A hollow mandrel 38 has a threaded surface at the upper marginal end thereof which threadedly engages threads 36 of the sub so that the resultant coacting concentrically arranged sub and mandrel present a downwardly opening annular space at 42. The mandrel has an axial passageway 44 which permits communication from the upper tubing string, down through the vent assembly, and on down through the lower tubing string so that communication between apparatus 28 of FIG. 1 and the surface of the ground can be effected. The inside diameter 46 of the sub is therefore spaced from the outside diameter 48 of the mandrel to form a downwardly opening chamber 50 therebetween.

A sliding sleeve 52 has an uppermost end 54 spaced from end wall 56 of chamber 50. The lower end 58 of the sliding sleeve can be reciprocated toward a circumferentially extending shoulder 60 formed on the exterior of the mandrel. The cylindrical wall 46 of the sub increases at the circumferentially extending shoulder 62 to form a larger i.d. cylindrical wall 64 on the interior of the skirt member.

The sliding sleeve has a relative small o.d. length 66 which is enlarged to form a relatively large o.d. length at 67. Annular grooves 68 and 69 are formed within the exterior surface 66 of the sleeve. Shoulder 72 is formed between surfaces 66 and 67, and abuttingly engages interior shoulder 62 of the sub. Accordingly, there are two expansion chambers, that is, upper chamber 50 and lower chamber 70, as will be discussed more fully later on in this disclosure.

The mandrel has a plurality of radially spaced ports 74 which come into registry with ports 26 of the sliding sleeve when the sleeve is in its downwardmost position. O-rings 76–82 seal the intervening surface between the mandrel and the sliding sleeve, and between the sliding sleeve and the skirt member, so that when the sleeve is in the uppermost or closed position, fluid flow through the co-acting elements of the tool is confined to the axial passageway.

A shear pin 83 is force fitted into the sleeve and received within a small drilled hole 84 formed within a sidewall of the mandrel. An index pin 85 is received in fixed relationship within drilled hole 86 of the sleeve, and moves within the vertical aligned groove 87. This arrangement of the co-acting parts maintains the ports 74 of the mandrel in aligned relationship respective to the ports 26 of the sleeve so that when the sleeve moves in a downward direction, the ports are brought into registry respective to one another.

Flow port 88 is formed through the sidewall of the mandrel and communicates chamber 70 with the axial passageway 44. A spring loaded latch assembly 90 is comprised of a removal plug 92 which compresses the illustrated spring against a piston 94, so that the piston is urged against the sidewall 66 of the mandrel, so that the piston is received within the annular groove 68 when the sleeve is reciprocated in a downward or opened direction. This action locks the ports into the opened position as the ports move into registry with one another. Passageway 96 communicates the expansion chamber 70 with the axial passageway 44.

Those skilled in the art, having digested the foregoing disclosure material of this specification, will probably realize that the sliding sleeve is captured between the mandrel and sub, and acts as a piston; and, when pressure is effected within the axial passageway, the pressure differential forces the piston to move downwardly against shoulder 60.

In operation, the vent assembly is connected into the tubing string of the permanent completion apparatus in the manner of FIG. 1. As noted in FIGS. 2 and 3, it is possible to circulate or drop a tool 97 of various configurations down through the tubing string, whereupon the tool travels through the upper tubing string, through the axial passageway 44 of the vent assembly, and down to a jet perforating gun 28, for example, thereby detonating the gun firing head 98 and completing the well.

Assuming the well to be slanted as set forth in patent application Ser. No. 132,765, prior to circulating a bar 97 downhole, the internal pressure of the tubing is elevated by employing a suitable power pump which is monitored with a chart type pressure recorder. The tubing preferably is liquid filled, and liquid is pumped into the upper tubing string in order to elevate the internal tubing pressure, although nitrogen or other inert gases can be employed for this pressure elevation, if desired.

As the bottomhole tubing pressure reaches a value of approximately two thousand psi above the annulus pressure, with the annulus pressure being measured at a location below the packer, the pin 83 will shear, and the sleeve 52 will slam down and lock, thereby opening the vents as ports 26 and 74 move into aligned relationship respective to one another.

The slope of the pressure curve will change as the tubing and the casing fluid pressures equalize. Pumping into the upper tubing string is continued to cause the tubing pressure to further increase. The pressure is next bled off, and increased again to the same previous volume of liquid or gas. The relative configuration of the two recorded curves indicate whether or not the vent assembly has been actuated to the opened position, thereby indicating that the well completion technique can be continued safely.

The annular area at 42, that is, the cross-sectional area of the annulus defined by the cylinder walls 46 and 48, multiplied by the pressure effected through ports 88 and 96, determine the downward force exerted upon the sliding sleeve. The shear pin must be sized according to this calculated force.

As the pin shears, the sleeve is rapidly forced downwardly until edge portion 58 thereof abuttingly engages the shoulder 60 of the mandrel. During this time, the guide pin 86 rides within the vertical groove 87, thereby aligning port 74 with port 26. The circumferentially extending groove 68 moves into aligned relationship with respect to the spring loaded plug or lock 96 which is received therewithin so that the sleeve is positively locked into the opened position.

Initially, just as the pin shears, there is pressure effected within both chambers 50 and 70, as seen at 50' and 70' on the right half of FIG. 2. After the pin shears and the sleeve travels a short distance, the passageway 96 is closed as it passes the lower end of groove 87. This effectively reduces the cross-sectional area of the sleeve which is subjected to the internal tubing pressure. Accordingly, the sleeve commences opening under a large force and then is subjected to a reduced force during the final part of its downward stroke. This reduction in force is adequate to ensure full stroke of the sleeve, while the sleeve is protected from damage which may result from excessive impact against the shoulder 60. Hence, the opening stroke of the sleeve is carried out in two steps; a large opening force to assure that the pin shears, and a reduced force to assure full travel of the sleeve. The groove 87 serves as a guide means for guide pin 86 as well as a passageway for flow from 44, 88, 87, 96, and into annular chamber 70. Flow from 44 through 84 and into chamber 50 occurs about the upper marginal end of the sleeve, the tolerance between the coacting sliding surfaces being of a value which enables a small flow to occur into chamber 50.

Accordingly, upon initial opening movement, the entire cross-sectional area of the sleeve is subjected to the pressure at 44, and thereafter, only the upper reduced diameter cross-sectional area of the sleeve is subjected to the pressure effected at 44.

It will now be evident to those skilled in the art that pressure is effected at 50' by flow which occurs through the passageway at 84 and 88, while the chamber 70' is communicated with the pressure source at 44 by means of passageways 88 and 96.

The present invention can be used in borehole operations which are severely slanted as contrasted to boreholes which are vertically disposed.

We claim:

1. A pressure actuated vent assembly for connection in series relationship within a tubing string comprising an outer sub having an axial passageway formed therethrough, and an upper marginal end for series connection into a tubing string; the lower marginal end of said sub being in the form of a downwardly depending, circumferentially extending skirt;

a mandrel having an axial passage formed therein, with one end affixed to said sub, a marginal length of said mandrel is spaced from said skirt of said sub to form a downwardly opening circumferentially extending annulus; a lower end of said mandrel is threaded so that it can be threadedly connected into a tubing string;

a sliding sleeve reciprocatingly received within said annulus; means forming a port through said mandrel, means forming a port through said sleeve in indexed relationship respective to the mandrel port, and seal means by which fluid flow is prevented from flowing between said sleeve and mandrel;

and means communicating the upper end of the sleeve with said axial passageway so that when pressure is effected within said axial passageway, pressure forces the sleeve to move in a downhole direction thereby aligning the sleeve and mandrel ports so that fluid can flow through said sleeve and mandrel ports and into said axial passageway;

means releasably affixing said sliding sleeve respective to said mandrel so that said sleeve remains in a closed position until an elevated pressure is effected above said sleeve;

and a latch means for engaging said sleeve when the sleeve moves to the opened position so that the sleeve is latched in the opened position.

2. The apparatus of claim 1 and further including guide means between said sleeve and said mandrel by which the port in the mandrel and the port in the sleeve are brought into registry with one another.

3. The apparatus of claim 1 wherein said sliding sleeve and said downwardly opening annular area includes means forming a second variable chamber;

and further including means forming another flow port which forms a flow path from said axial passageway to said second variable chamber to provide a large opening force during the initial opening movement of the sliding sleeve, and thereafter provide a relatively smaller force during the final opening movement.

4. The apparatus of claim 1 wherein the upper marginal length of said downwardly opening annulus is of a relatively small cross-sectional area which increases in cross-sectional area at the lower marginal length thereof; and, said sliding sleeve has a relatively small cross-sectional area at the upper marginal length thereof which forms a first working chamber and a relatively large cross-sectional area at the lower marginal length thereof which forms a second working chamber;

and flow passageway means for communicating the axial passageway with both the first and second annular working chambers when the sleeve is in the closed position, and for communicating the axial passageway with only one of said annular working chambers during final movement of the piston towards the opened position.

5. A pressure actuated vent assembly for connection in series relationship within a tubing string comprising an outer sub having an axial passageway formed therethrough, and an upper marginal end for series connection into a tubing string; the lower marginal end of said sub being in the form of a downwardly depending, circumferentially extending skirt;

a mandrel having an axial passage formed therein, with one end affixed to said sub, a marginal length of said mandrel is spaced from said skirt of said sub to form a downwardly opening circumferentially extending annulus; a lower end of said mandrel is threaded so that it can be threadedly connected into a tubing string;

a sliding sleeve reciprocatingly received within said annulus; means forming a port through said mandrel, means forming a port through said sleeve in indexed relationship respective to the mandrel port, and seal means by which fluid flow is prevented from flowing between said sleeve and mandrel;

and means communicating the upper end of the sleeve with said axial passageway so that when pressure is effected within said axial passageway, pressure forces the sleeve to move in a downhole direction thereby aligning the sleeve and mandrel ports so that fluid can flow through said sleeve and mandrel ports and into said axial passageway;

the upper marginal length of said sleeve has a cross-sectional area which is relatively smaller than the cross-sectional area of a medial length of said sleeve; said annulus has an upper marginal length of a size to slidably receive said upper marginal length of said sleeve; said annulus includes another length of a size to slidably receive said medial length of said sleeve so that the sleeve is subjected to a large initial opening force and thereafter is subjected to a relatively smaller force during the final opening stroke.

6. The pressure actuated vent assembly of claim 5 wherein a shear pin affixes said sliding sleeve respective to said mandrel so that said sliding sleeve remains in the closed position until a predetermined pressure is effected above said sleeve.

7. The pressure actuated vent assembly of claim 5 and further including a latch means which engages the sleeve when the sleeve moves to the opened position so that the sleeve is latched in the opened position.

8. The apparatus of claim 7 and further including guide means between said sleeve and said mandrel by which the ports in the mandrel and the ports in the sleeve are brought into registry with one another.

9. In a cased borehole extending downhole from the surface of the earth, and a tubing string arranged concentrically with respect to the casing, a perforating gun connected to the lower end of the tubing string, a packer interposed between the casing and the tubing string for isolating the lower casing annulus from the upper casing annulus, the combination with said tubing, packer, and gun of a pressure actuated vent assembly;

said vent assembly includes a sub having an upper end affixed to an upper length of the tubing string; a mandrel having an axial passageway formed therethrough, an upper marginal interior surface of said sub is affixed to the upper marginal end of said mandrel;

said mandrel extends downwardly from attached concentric relationship respective to an upper marginal length of said sub, with there being a downwardly opening annular area formed between said sub and the outer wall of said mandrel; means by which the lower marginal end of said mandrel is affixed to a lower length of the tubing string;

a sliding sleeve reciprocatingly received within said downwardly opening annular area and forming a variable chamber therewith; means forming a flow port through said mandrel for communicating the variable chamber with the axial passageway of the mandrel;

stop means for limiting the downward movement of said sleeve, a radial port formed in said sleeve, a radial port formed in said mandrel in registry with the sleeve port;

means for holding the sleeve in the upper position so that the ports are closed; means for maintaining the sleeve orientated such that the ports of the sleeve and mandrel are indexed with one another when the sleeve is moved to the opened position;

and means for holding the sleeve in the opened position when the sleeve is slidably reciprocated to its lowermost position.

10. The combination of claim 9 wherein said gun includes a gun firing head which detonates the charges of the gun in response to impact, said head extends into said tubing; and, the upper marginal end of said sub is threaded, the lower marginal end of said mandrel is threaded, so that the vent assembly can be threadedly made up into the tubing string.

11. The combination of claim 9 wherein said sleeve is releasably held in the closed position by a shear pin, and is latched into the opened position by a spring loaded piston which engages a recess formed on the exterior of the sleeve.

12. The combination of claim 9 wherein said vent assembly includes means by which said sleeve is subjected to a large initial opening force and thereafter is subjected to a relatively smaller force during the final opening stroke.

13. The combination of claim 9 wherein a shear pin affixes said sliding sleeve respective to said mandrel so that said sliding sleeve remains in the closed position until a predetermined pressure is effected above said sleeve;

and further including a latch means which engages the sleeve when the sleeve moves to the opened position so that the sleeve is latched in the opened position.

14. In a cased borehole having a tubing string attached to a perforating gun device, a packer located along the tubing string and dividing the casing annulus into an upper and lower annular area, and a vent assembly located between the gun and packer, the method of completing the well comprising the steps of:

(1) positioning the gun adjacent to a hydrocarbon containing formation;

(2) providing said gun with a gun firing head which extends into the lower end of the lower tubing string so that the gun can be detonated by extending a detonation device down through the interior of the tubing string and into contact with the gun firing head;

(3) providing said vent assembly with a ported annular body; forming an annular chamber within said ported annular body and slidably mounting a ported sleeve within said annular chamber and concentrically respective to the ported annular body;

(4) effecting a pressure differential between the tubing and lower annular area, by elevating the pressure within the tubing string;

(5) using the pressure differential of step (4) to force the sleeve to slide axially of said annular body;

(6) using the sliding movement of step (5) to cause the ports within the annular body to register with the ports in the sleeve;

(7) detonating the gun by extending a detonation device down through the interior of the tubing.

15. The method of claim 14 and further including the step of slanting the borehole, and circulating a detonation device downhole into contact with the gun firing head in order to fire the gun.

16. The method of claim 14 wherein the gun firing head is provided with means which detonates the gun upon impact of an object thereagainst; and, the detonation device of step (7) is forced to impact against the gun firing head by circulating the detonation device downhole through the tubing string.

17. The method of claim 14 and further including the steps of:

(8) providing the gun firing head with means responsive to impact for detonating the gun;

(9) dropping a weighted object downhole through the tubing string after step (6) has been carried out, thereby causing the object to impact against the gun firing head and detonate the gun, which perforates the casing;

(10) flowing hydrocarbons from the hydrocarbon containing formation, up the lower annular area, into the ports of the vent assembly, and up the upper tubing string to the surface of the earth, where the hydrocarbons may be gathered for use.

18. The method of claim 14 and further including the steps of releasably holding the sleeve until the pressure differential of step (4) reaches a predetermined value before carrying out step (5).

19. A pressure actuated vent assembly for connection in series relationship within a tubing string comprising an outer sub having an axial passageway formed therethrough, and an upper marginal end for series connection into a tubing string; the lower marginal end of said sub being in the form of a downwardly depending, circumferentially extending skirt;

a mandrel having an axial passage formed therein, with one end affixed to said sub, a marginal length of said mandrel is spaced from said skirt of said sub to form a downwardly opening circumferentially extending annulus; a lower end of said mandrel is threaded so that it can be threadedly connected into a tubing string;

a sliding sleeve reciprocatingly received within said annulus; means forming ports through said mandrel, means forming ports through said sleeve in indexed relationship respective to the skirt ports, and seal means by which fluid flow is prevented from flowing between said sleeve and mandrel;

and means communicating the upper end of the sleeve with said axial passageway so that when pressure is effected within said axial passageway, pressure forces the sleeve to move in a downhole direction thereby aligning the sleeve and mandrel ports so that fluid can flow through said sleeve and mandrel ports and into said axial passageway;

means releasably holding said sleeve in the closed position until the pressure effected within said axial passageway exceeds a predetermined value;

means by which said sleeve is subjected to a large initial opening force which releases said means releasably holding said sleeve, and thereafter said sleeve is subjected to a relatively smaller force during the final opening stroke.

20. The vent assembly of claim 19 wherein said means releasably holding said sleeve is a shear pin; and, said sleeve is latched into the opened position by a spring loaded piston which engages a recess formed on the exterior surface of the sleeve.

* * * * *

UNITED STATES PATENT AND TRADEMARK OFFICE

CERTIFICATE OF CORRECTION

PATENT NO. : 4,330,039

DATED : May 18, 1982

INVENTOR(S) : Roy R. Vann, et al

It is certified that error appears in the above—identified patent and that said Letters Patent is hereby corrected as shown below:

Column 1, line 20; Before "U.S."

insert -- In--.

Column 2, line 47; change "bottomof" to

-- bottom of --.

Column 10, line 11; delete "skirt"

and insert -- mandrel --.

Signed and Sealed this

*Twenty-first* Day of *September 1982*

[SEAL]

*Attest:*

GERALD J. MOSSINGHOFF

*Attesting Officer*

*Commissioner of Patents and Trademarks*